US008276687B2

(12) United States Patent
Malcolm

(10) Patent No.: US 8,276,687 B2
(45) Date of Patent: Oct. 2, 2012

(54) STEERING HEAD

(75) Inventor: William Malcolm, Dana Point, CA (US)

(73) Assignee: McLaughlin Group, Inc., Greenville, SC (US)

( * ) Notice: Subject to any disclaimer, the term of this patent is extended or adjusted under 35 U.S.C. 154(b) by 222 days.

(21) Appl. No.: 12/433,587

(22) Filed: Apr. 30, 2009

(65) Prior Publication Data

US 2010/0276203 A1 Nov. 4, 2010

(51) Int. Cl.
*E21B 7/08* (2006.01)

(52) U.S. Cl. ..... 175/73

(58) Field of Classification Search ..... 405/138, 405/141–143; 175/61, 73; 299/1.3
See application file for complete search history.

(56) References Cited

U.S. PATENT DOCUMENTS

| | | | | |
|---|---|---|---|---|
| 3,554,302 | A * | 1/1971 | Adkins et al. | 175/26 |
| 3,630,295 | A * | 12/1971 | Coyne et al. | 175/73 |
| 3,767,836 | A | 10/1973 | Geis et al. | |
| 3,778,107 | A * | 12/1973 | Haspert | 299/11 |
| 4,042,046 | A | 8/1977 | Capoccia | |
| 4,059,163 | A * | 11/1977 | Stedman | 175/73 |
| 4,438,820 | A | 3/1984 | Gibson | |
| 4,605,075 | A * | 8/1986 | Radford et al. | 175/58 |
| 4,655,493 | A | 4/1987 | Sumi | |
| 4,763,954 | A | 8/1988 | Soltau | |
| 5,061,120 | A | 10/1991 | Akesaka | |
| 5,099,927 | A | 3/1992 | Gibson et al. | |
| 5,361,854 | A | 11/1994 | Tull et al. | |
| 5,813,482 | A | 9/1998 | Barbera | |
| 6,607,045 | B2 * | 8/2003 | Beyerl | 175/73 |
| 7,389,831 | B2 | 6/2008 | Mullins et al. | |
| 2002/0020559 | A1 | 2/2002 | Barbera et al. | |

(Continued)

FOREIGN PATENT DOCUMENTS

WO WO2010030784 3/2010

OTHER PUBLICATIONS

Brochure for McLaughlin Cased Auger Boring 16"-54" showing the use of an existing piece of casing cut into two sections and held together by welded hinges, a threaded steering knuckle pushes or pulls the front section of the casing up or down to control the elevational or vertical direction of the bore. Also shown are tools used to make the McLaughlin bore. See Exhibit "A" attached hereto.

(Continued)

*Primary Examiner* — William P Neuder
(74) *Attorney, Agent, or Firm* — Nelson Mullins Riley & Scarborough, LLP

(57) ABSTRACT

A steering head for use with an auger and a casing engaged to the auger, the steering head comprising: a generally cylindrical body having a first body end and a second body end mountable to the casing, a bore channel concentrically received in the body, a front lip, a rear lip, a body surface, and a lead edge; an outer tube having an internal side covering the body surface and an opposing external side; a steering flap disposed on the external side of the outer tube having a first flap face and a second flap face, a distal end, and a hinge end, the steering flap disposable in a retracted position and an extended position; a biased hinge operative to retract the steering flap into the retracted position; and a powered actuator operative to extend the first flap face into the extended position.

20 Claims, 4 Drawing Sheets

U.S. PATENT DOCUMENTS

| | | | | |
|---|---|---|---|---|
| 2004/0245020 | A1* | 12/2004 | Giroux et al. | 175/61 |
| 2007/0089906 | A1 | 4/2007 | Davies | |

OTHER PUBLICATIONS

Photograph of an earlier version of Applicant's Steering Head showing its longer body, smaller steering flaps positioned flush with the outside casing, and lacking amongst others a biased hinge, SONDE housing and powered actuator on the steering flaps. See Exhibit "B" attached hereto.

Office Action dated Dec. 14, 2011 for co-pending U.S. Appl. No. 13/243,231.

* cited by examiner

STEERING HEAD

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to a steering head for use with an auger for boring through soil.

Underground dredging and boring operations are necessary for the laying of underground utility lines (e.g. water, sewer, and power). The boring or tunneling of the soil to clear a path for such underground utility lines requires the use of a steering head, a casing, an auger unit, and an auger machine. The casing is typically weldably mounted to the steering head at one end and engaged to the auger machine at the opposite end, with an auger unit extending from the auger machine through the casing and into the steering head. The auger machine rotates the auger, thereby enabling the auger unit to perform the boring or tunneling operation through the surrounding soil. The auger removes the soil through the steering head and into the auger machine. As the bore hole is lengthened, additional sections of casing are welded to previously laid casings until a utility crossing line is completed. The auger machine, auger, and steering head are then removed, and a utility line is then run through the interconnected casings.

The cutting direction of the steering head through the soil will largely determine the path of the underground piping. Accordingly, the maneuverability of the steering head is critical to accurately cutting a desired path through the soil. The more maneuverable the steering head, the easier it may be to accurately steer through the soil. As a result, the maneuverability of the steering head may also improve the efficiency of the boring operation.

It is understood that prior art steering heads included a lateral hinge on each side of the steering head. A pipe-like rod mounted on top of the steering head by a nut and bolt configuration engageably connected each lateral hinge. The rotational loosening or tightening of the nut and bolt by a wrench allowed the position of each lateral hinge to be modified, thereby enabling the adjustment of the elevational direction of the steering head along a vertical axis. However, the position of the steering head along a horizontal axis could not be adjusted in these prior art steering heads. Furthermore, the amount of vertical adjustment was limited by the amount of torsion that could be applied to the nut and bolt configuration Other prior art steering heads utilized projections allowing some adjustment of the direction of the steering head along both vertical and horizontal axes. However, it is understood that the projections on these steering heads could not be completely closed. As a result, the frictional and impact forces between the projections and the surrounding soil wall as well as the penetration of soil under these projections reduced the efficiency of operation and maneuverability of these steering heads. Accordingly, more power and time was required to complete the boring operation. This resulted in increased labor and utility costs budgeted for a project. Furthermore, it is understood that the repeated impact between the steering head projections and the soil wall deformed these projections, thereby damaging the steering head and reducing its operational efficiency, resulting in added equipment and repair costs. In order to partially offset the occurrence of deformation, it is understood that these prior art steering head projections could be partially closed manually, a process that again reduced the efficiency of the boring operation.

Accordingly, there appears to be a need in the art for a new steering head with increased maneuverability along vertical and horizontal axes through various types of soil material for increased efficiency in the boring operation.

BRIEF SUMMARY

According to an aspect of the present invention, there is provided a steering head for use with an auger and a casing engaged to the auger for boring through soil. The steering head comprises a generally cylindrical body defining a longitudinal body axis. The body may have a first body end and an opposing second body end. The second body end may be mounted to the casing. The body may further have a bore channel with a channel surface concentrically received in the body, a front lip radially extending from the bore channel proximate to the first body end, and a rear lip radially extending from the bore channel proximate to the second body end. The body may further have a body surface enveloping the body from the front lip to the rear lip. The body may also have a lead edge radially extending from the front lip at the first body end, with the lead edge having a first soil face and an opposing lead face. The steering head may further have an outer tube having an internal side and an opposing external side. The internal side may generally face and be operative to cover the body surface and the lead face from the first body end to the second body end. The steering head may further have a steering flap disposed on the external side of the outer tube defining a longitudinal flap axis and a generally lateral flap axis disposed perpendicular to the longitudinal flap axis. The steering flap may have a first flap face and an opposing second flap face. The first flap face may be disposable facing toward and generally parallel to the body surface in a retracted position. The first flap face may be disposable radially away from the body surface in an extended position. The steering flap may further have a distal end and a hinge end. The hinge end may generally be disposed between a distal end and the lead edge. The hinge end may be mountable to the outer tube by a biased hinge operative to retract the steering flap into the retracted position. The steering head may further have a powered actuator mountable to the first flap face and the body surface. The powered actuator when activated may be operative to extend the first flap face into the extended position.

The steering head is innovative in that the powered actuator may be mounted to the first flap face of the steering flap and the body surface of the steering head's body. When operative, the powered actuator may extend the first flap face into the extended position, thereby enabling the steering head to change the direction of its cutting path. In the extended position, the steering flap will encounter frictional resistance forces with the soil wall, thereby causing the lead edge of the steering head to move in a direction opposing the extended steering flap. For example, if a steering flap on the right side of the steering head is extended, the lead edge of the steering head will tend to move in a direction toward the left through the soil. These same frictional resistance forces will cause the lead edge of the steering to tend to move in an upward direction in the soil with a steering flap extended on the bottom of the steering head. Once the desired alignment has been achieved, the powered actuator may then be deactivated. This in turn uniquely enables the biased hinge at the hinge end of the steering flap to automatically retract the steering flap into a completely closed position by operation of the spring action of the biased hinge with the assistance of the frictional impact forces of the soil wall pushing on the steering flap. This configuration uniquely allows the steering head to be more maneuverable and therefore easier to steer through a desired cutting path in the soil, along both vertical and longitudinal axes. The steering head is therefore able to operate more efficiently, thereby reducing the amount of time spent and power consumed in the boring operation on a project. Furthermore, as the steering flap may be automatically closed at the hinge end by the biased hinge, the steering flap may be less likely to be deformed or allow soil to enter the steering head underneath a steering flap in the extended position. Accordingly, the steering flap may not sustain damage as frequently during the boring operation and its longevity may therefore be increased.

According to other embodiments of the present invention, the body of the steering head may be made of any durable metal, including steel. Similarly, the lead edge of the steering head may also be made of a durable metal, including steel.

In a further embodiment of the present invention, the steering head may further include a stiffening ring concentrically extending from the front lip proximate to the lead edge. The stiffening ring may have a second soil face facing toward the longitudinal body axis. The stiffening ring may further have an opposing ring face covered by the outer tube facing away from the longitudinal body axis between the body surface and the lead face.

In another embodiment, the steering head may further include a rear edge concentrically extending from the rear lip and mountable to the casing. The rear edge may have a casing face facing toward the longitudinal body axis and an opposing rear face facing away from the longitudinal body axis. The rear face may be covered by the outer tube.

In yet a further embodiment, the steering head may include a plurality of steering flaps disposed on the external side of the outer tube. Each steering flap may define a longitudinal flap axis and a generally lateral flap axis disposed perpendicular to the longitudinal flap axis. Each steering flap may have a first flap face and an opposing second flap face. Each first flap face may be disposable facing toward and generally parallel to the body surface in a retracted position. Each first flap face may be disposable radially away from the body surface in an extended position. Each steering flap may further have a distal end and an opposing hinge end. Each hinge end may be generally disposed between the distal end and the lead edge. Each hinge end may be mountable to the outer tube by a biased hinge operative to retract the steering flap into the retracted position.

As discussed above, this configuration uniquely enables the steering head to be more maneuverable in soil and therefore more efficient in its boring operation. The plurality of steering flaps may enable an efficient change of direction of the steering head toward the desired cutting path. For example, if a steering flap on the right side of the steering head is extended, a steering head on the left side of the steering head may be retracted, thereby steering the lead edge of the steering head toward the left. Likewise, these same frictional resistance forces will cause the lead edge of the steering to tend to move in an upward direction in the soil with a steering flap extended on the bottom of the steering head and retracted on the top of the steering head. With the deactivation of the powered actuator on a steering flap, the configuration of the spring action on the biased hinge of each deactivated steering flap uniquely enables these steering flaps to uniformly retract with the assistance of the frictional impact forces of the soil wall on the steering flaps. This configuration may therefore improve the efficiency of the boring operation and the longevity of the steering head.

In another embodiment, the biased hinge on the steering flap may be spring-loaded. In an alternative embodiment, the biased hinge may be made of spring steel. As discussed above, the spring operation of the biased hinge uniquely enables the steering flaps to retract into their retracted position with the assistance of the frictional impact forces of the soil wall.

According to another embodiment of the present invention, the steering head may further include a plurality of biased hinges on the hinge end of the steering flap.

In another embodiment, the steering head may have a plurality of powered actuators mounted to the first flap face of each steering flap.

In another embodiment, the powered actuator may be a hydraulic air or electric actuator having a motor, a cylinder, and a shaft. The shaft may be mounted to the first flap face. The hydraulic air or electric actuator may be operative to extend the first flap face, with the cylinder powered by the motor in the case of an electric actuator to extend the shaft mounted to the first flap face.

According to another embodiment, a steering head may include a plurality of powered actuators, with each steering flap having a powered actuator mountable to each first flap face.

In yet a further embodiment, the steering head may include an altitude sensor disposed on the outer tube proximate to the second body end. The altitude sensor may be operative to measure the position of the steering head along a vertical soil axis in the soil. In another embodiment, the steering head may also include a first positional sensor on the rear lip proximate to the second body end. The first positional sensor may be operative to measure the position of the steering head along a horizontal soil axis in the soil. The steering head may also include a second positional sensor adjacent to the first positional sensor.

The combination of an altitude sensor and one or more positional sensors may uniquely enable the steering head to be accurately positioned in the desired cutting path of the soil, along vertical and horizontal axes. The information gathered by the altitude sensor and the positional sensors may therefore indicate when one or more of the steering flaps should be extended or retracted, depending on the position of the steering head in reference to the desired cutting path.

In yet a further embodiment, the steering head may further include a rear hatch on the outer tube proximate to the second body end. The rear hatch may be operative to cover at least one power and/or communication line from an external control system to the steering head. In another embodiment, the steering head may also include a top box on the outer tube extending from the rear hatch toward the first body end. In one embodiment, the top box may be operative to cover a multifunctional sensor positioned underneath the top box. The multifunctional sensor may be operative to measure the depth, position, pitch, and roll of the steering head in the soil.

In another embodiment of the present invention, the steering head may further include one or more shields laterally disposed on the first flap face of the steering flap adjacent to the outer tube. The shields may be operative to prevent soil from entering beneath the steering flap in the extended position and to provide support to the steering flap. In another embodiment, a center rib may be disposed proximate to the shields operative to provide additional support to the steering flap.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The drawings referred to herein are for the purposes of illustrating the preferred embodiments of the present invention and not for the purposes of limiting the same.

Figures 1, 1A, 1B:
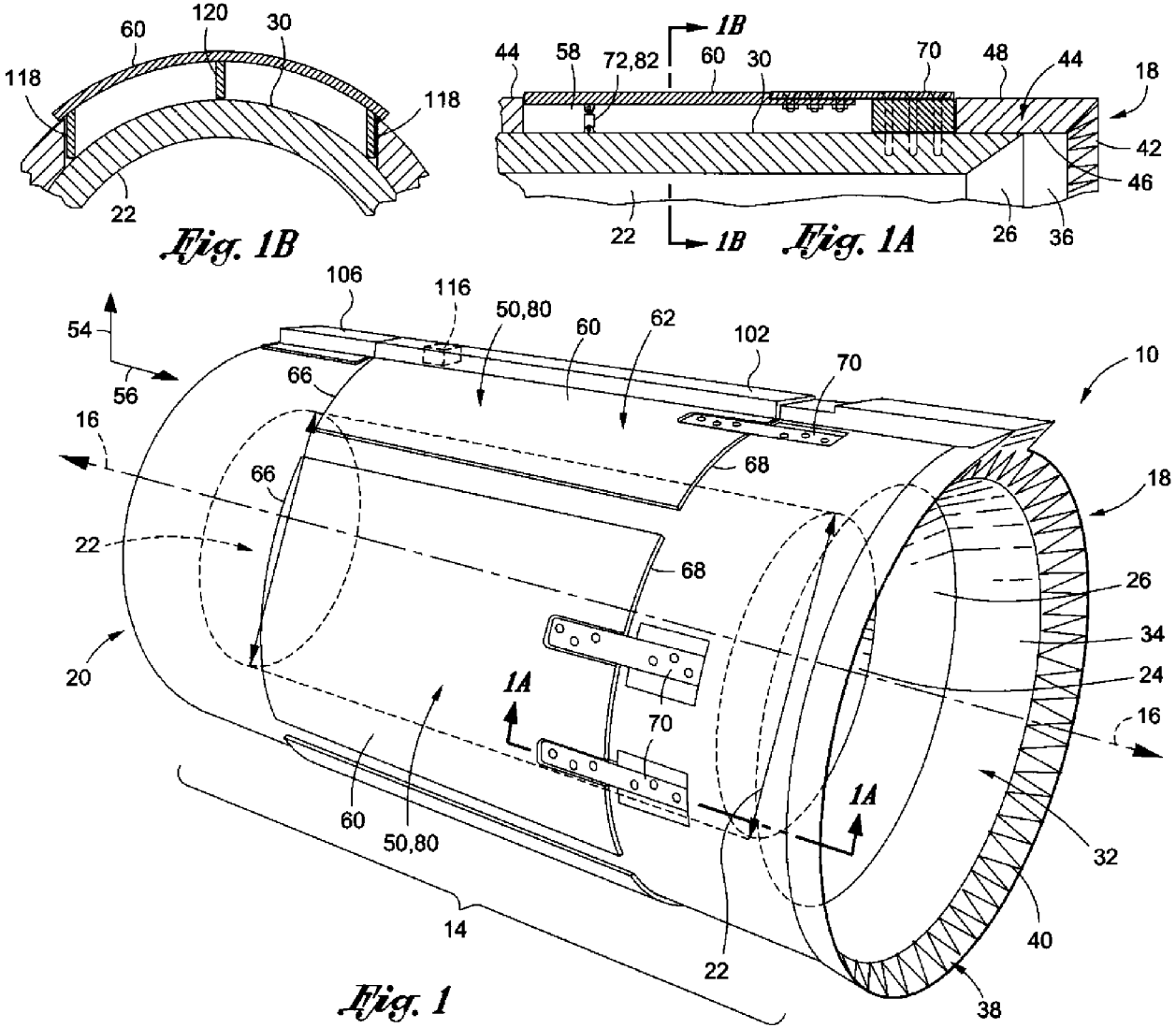
FIG. 1 is a perspective view of the steering head showing a plurality of steering flaps with biased hinges in the retracted position.
FIG. 1A is a cross-sectional view of one steering flap mounted to the outer tube in the retracted position.
FIG. 1B is a cross-sectional view of two shields and a center rib disposed on the first flap face of the steering flap.
Figure 2:
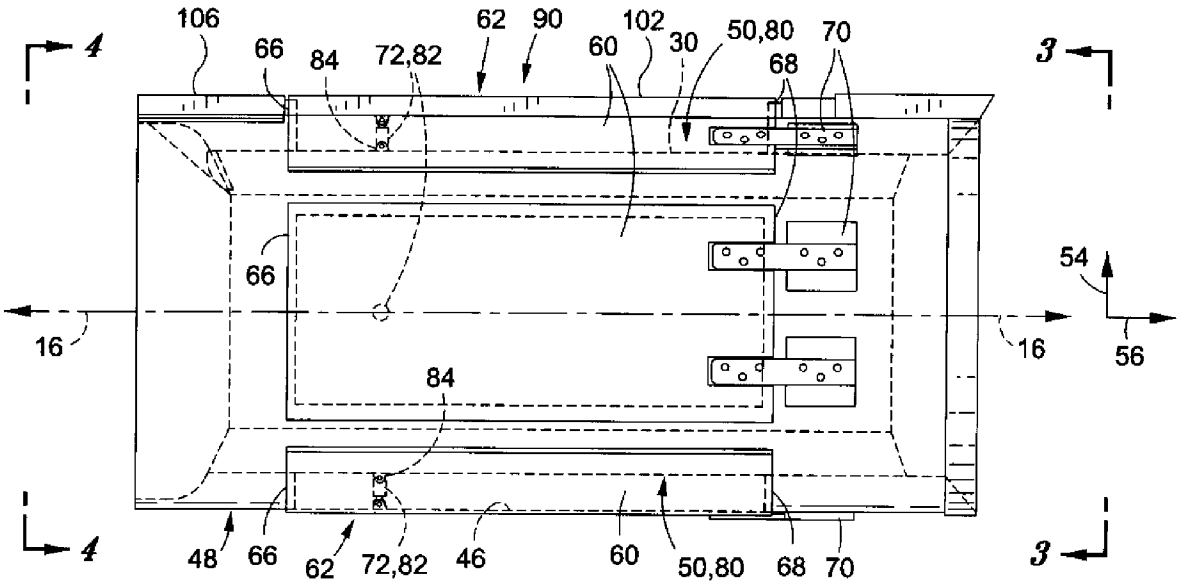
FIG. 2 is a top view of the steering head showing a plurality of steering flaps with biased hinges in the retracted position.
Figure 6:
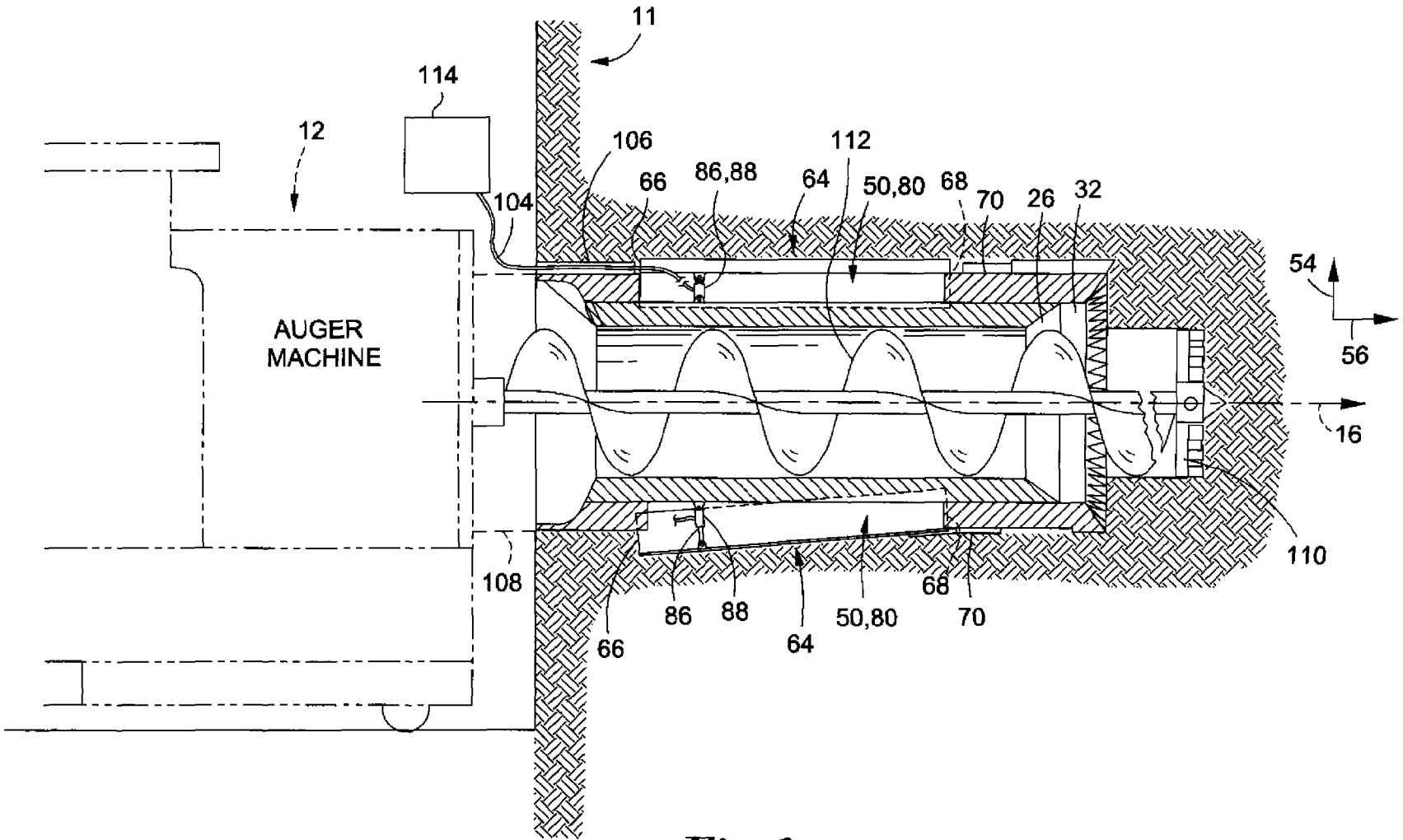
FIG. 6 is a perspective view of an embodiment of the steering head with the second body end engaged to a casing with one of the steering flaps in the extended position.

FIGS. 1 and 2 are an embodiment of the steering head 10 having a generally cylindrical body 14 defining a longitudinal body axis 16. The body 14 may have a first body end 18 and an opposing second body end 20. The second body end 20 of the steering head 10 may be mounted to a casing 108 as depicted in FIG. 6, preferably by welding. As shown in FIG. 6, the casing 108 is also engaged to an auger machine 12, with an auger unit 112 engaged to and extending from the auger machine 12 through the casing and the steering head 10. The auger unit 112 may be equipped with a drill bit 110 for cutting through various types of soil 11, from running sand to round rock. The auger machine 12 rotates the auger unit 112, thereby enabling the auger unit 112 to perform a boring or tunneling operation through the surrounding soil 11. The auger unit 112 removes the soil 11 through the steering head 10 and into the auger machine 12. As the bore hole is lengthened, additional sections of casing 108 are welded to previously laid casings 108 until a utility crossing line is completed. The auger machine 12, auger unit 112, and steering head 10 are then removed, and a utility line (e.g. power, water, sewer) may then run through the interconnected casings 108.

Figure 3:
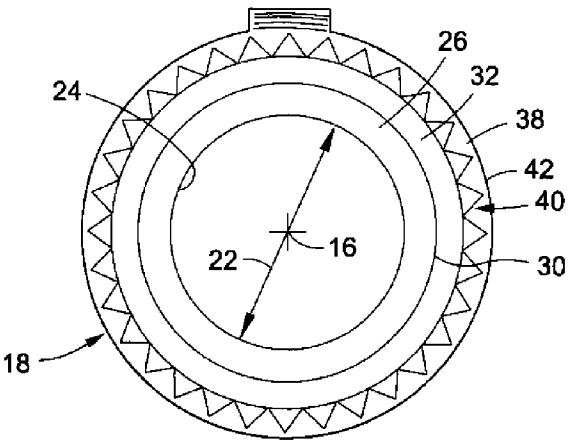
FIG. 3 is a frontal view of the steering head body from the first body end showing the bore channel with a channel surface concentrically received in the body, a front lip, a steering head, and a lead edge.

Referring again to FIGS. 1 and 2, the body 14 of the steering head 10 may further have a bore channel 22 with a channel surface 24 concentrically received in the body 14. The body 14 may have a front lip 26 radially extending from and generally perpendicular to the bore channel 22 proximate to the first body end 18. However, it is also contemplated within the scope of the present invention that the front lip 26 may be tapered or non-orthogonal to the bore channel 22. The body 14 may further have a rear lip 28 radially extending from the bore channel 22 proximate to the second body end 20. A body surface 30 envelops the exterior of the body 14 extending from the front lip 26 to the rear lip 28. Both the front lip 26 and the rear lip 28 are hollow in the preferred embodiment of the steering head 10, although it is contemplated that the front lip 26 and the rear lip 28 may be solid if made of a relatively lightweight durable material. The body 14 may further have a lead edge 38 radially extending from the front lip 26 at the first body end 18. As discussed below, FIGS. 1-3 depict an embodiment of the steering head 10 having a stiffening ring 32. In this embodiment, the lead edge 38 is shown to radially extend from the stiffening ring 32, not the front lip 26. The lead edge 38 may have a first soil face 40 that comes into contact with and cuts through the soil 11. The lead edge 38 may further have a lead face 42 opposing the first soil face 40, as shown in FIG. 1A. The first soil face 40 of the lead edge 38 may be comprised of a welded metal material for added durability and strength in cutting through soil 11 as well as rock material.

In one embodiment of the steering head 10, the distance between the front lip 26 and the rear lip 28 is approximately 48 inches. However, it is contemplated within the scope of the present invention that the distance from the front lip 26 to the rear lip 28 may be more or less than 48 inches, depending on the requirements of the boring operation.

Although the steering head 10 depicted in FIGS. 1 and 2 is cylindrical, it is also contemplated within the scope of the present invention that the various aspects of the steering head 10 may be employed with a body 14 that has a polygonal, rectangular, or other configuration.

Still referring to FIG. 1, the body 14 is shown to have at its first body end 18 a bore channel 22 with a channel surface 24 concentrically received in the body 14 along a longitudinal body axis 16. A front lip 26 is shown radially extending from the bore channel 22 proximate to the first body end 18. FIG. 3 depicts the body surface 30 enveloping the body 14 beginning at the front lip 26. In the embodiment depicted in FIG. 3, the steering head 10 also includes a stiffening ring 32 concentrically extending from and generally perpendicular to the front lip 26 proximate to the lead edge 38. However, it is also contemplated within the scope of the present invention that the stiffening ring 32 may be tapered or non-orthogonal to the front lip 26. The stiffening ring 32 may have a second soil face 34 facing toward the longitudinal body axis 16 that makes contact with the soil 11 while the steering head 10 is in operation. As shown in the embodiment in FIG. 1A, the stiffening ring 32 may further have an opposing ring face 36 facing away from the longitudinal body axis 16 between the body surface 30 and the lead face 42. The stiffening ring 32 may reinforce the steering head 10 when it is used in a mixture of rock and soil 11. The stiffening ring 32 may therefore prevent the steering head 10 from bending or deformation when used in inconsistent soils 11. FIGS. 1-3 depict an embodiment of the steering head 10 having a lead edge 38 radially extending from the stiffening ring 32 at the first body end 18. As discussed above, the lead edge 38 may have a first soil face 40 and an opposing lead face 42.

Figure 4:
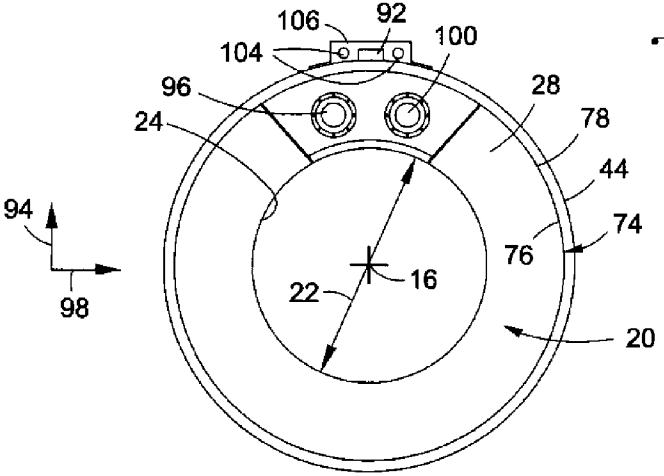
FIG. 4 is a rear view of the steering head from the second body end showing the rear lip radially extending from the bore channel, a rear edge, a first positional sensor, a second positional sensor, and an altitude sensor.

Referring now to an exploded rear view of an embodiment of the steering head 10 in FIG. 4, the rear lip 28 is shown radially extending from the bore channel 22 proximate to the second body end 20. In this embodiment, the steering head 10 may also include a rear edge 74 concentrically extending from the rear lip 28. FIG. 6 shows the rear edge 74 of the steering head 10 mounted to the casing 108. The rear edge 74 may have a casing face 76 facing toward the longitudinal body axis 16 and an opposing rear face 78 facing away from the longitudinal body axis 16.

Referring again to FIG. 1A, the steering head 10 may further include an outer tube 44 having an internal side 46 and an opposing external side 48. The internal side 46 may generally face and be operative to cover the body surface 30 and the lead face 42 spanning the first body end 18 to the second body end 20. In the embodiment depicted in FIG. 1A, the internal side 46 of the outer tube 44 also covers the ring face 36, with the ring face 36 facing away from the longitudinal body axis 16. In FIG. 4, the internal side 46 of the outer tube 44 is shown to cover the rear face 78 of the rear edge 74.

In one embodiment of the steering head 10 with an outer tube 44 whose diameter is greater than 30 inches, the bore channel 22 may have a corresponding diameter that is approximately 12 inches less than the diameter of the outer tube 44. However, it is contemplated within the scope of the present invention that the ratio of the diameter of the outer tube 44 and the bore channel 22 may be varied, depending on the requirements of the boring operation.

Although the steering head 10 may be typically made of metal such as steel to withstand the impact and frictional forces of soil 11 pressing upon the lead edge 38, the outer tube 44, and the channel surface 24, it is also contemplated within the scope of the present invention that the various aspects of the steering head 10 may be employed from any hard, durable material.

Referring again to FIGS. 1 and 2, the embodiment of the steering head 10 may have a plurality of steering flaps 50, 80 disposed on the external side 48 of the outer tube 44. The steering flaps 50, 80 define a longitudinal flap axis 54 and a generally lateral flap axis 56 disposed perpendicular to the longitudinal flap axis 54. The steering flaps 50 may each have a first flap face 58 and an opposing second flap face 60. The first flap face 58 may be disposable facing toward and generally parallel to the body surface 30 in a retracted position 62, as shown in FIGS. 1A and 2. Each of the steering flaps 50, 80 may have a distal end 66 and a hinge end 68, with the hinge end 68 generally disposed between the distal end 66 and the lead edge 38. The hinge end 68 may be mountable to the outer tube 44 by a biased hinge 70 operative to retract each of the steering flaps 50, 80 into the retracted position 62. In the embodiment of the steering head 10 in FIG. 2, each of the steering flaps 50, 80 is shown to have a plurality of biased hinges 70 on the distal end 66 of each hinge end 68 operative to retract each steering flap 50, 80 into the retracted position 62. Although the steering head 10 depicted in FIGS. 1-2 has a plurality of steering flaps 50, 80 disposed on the external side 48 of the outer tube 44, it is also contemplated within the scope of the present invention that a steering head 10 may only have a single steering flap 50, 80 disposed on the external side 48 of the outer tube 44. Furthermore, although FIGS. 1 and 2 both depict the steering head 10 having a plurality of biased hinges 70 on the hinge end 68 of each steering flap 50, 80, it is contemplated within the scope of the present invention that the steering head 10 may only have a single biased hinge 70 at the hinge end 68 of each steering flap 50, 80.

In one embodiment of the steering head 10, the steering flaps 50, 80 will have a diameter that is approximately ¼ inch wider than the diameter of the outer tube 44. This configuration uniquely enables the steering flaps 50, 80 to absorb most of the frictional resistance and impact forces with the soil wall 11, thereby potentially reducing the amount of drag and friction on the casing 108 mounted to the second body end 20 of the steering head 10. However, it is contemplated within the scope of the present invention that the diameter of the steering flaps 50, 80 as compared to the diameter of the outer tube 44 may be varied, depending on the requirements of the boring operation.

As shown in FIGS. 1-2, 5-6, it is contemplated within the scope of the present invention that the biased hinge 70 may either be spring-loaded or be made of a spring steel material. Furthermore, as shown in FIG. 1, the spring steel biased hinge 70 may be recessed into the second flap face 60 of the steering flap 50, 80. This configuration uniquely enables the steering flaps 50, 80 rather than the biased hinge 70 to absorb most of the frictional resistance and impact forces with the soil wall 11.

Figure 5:
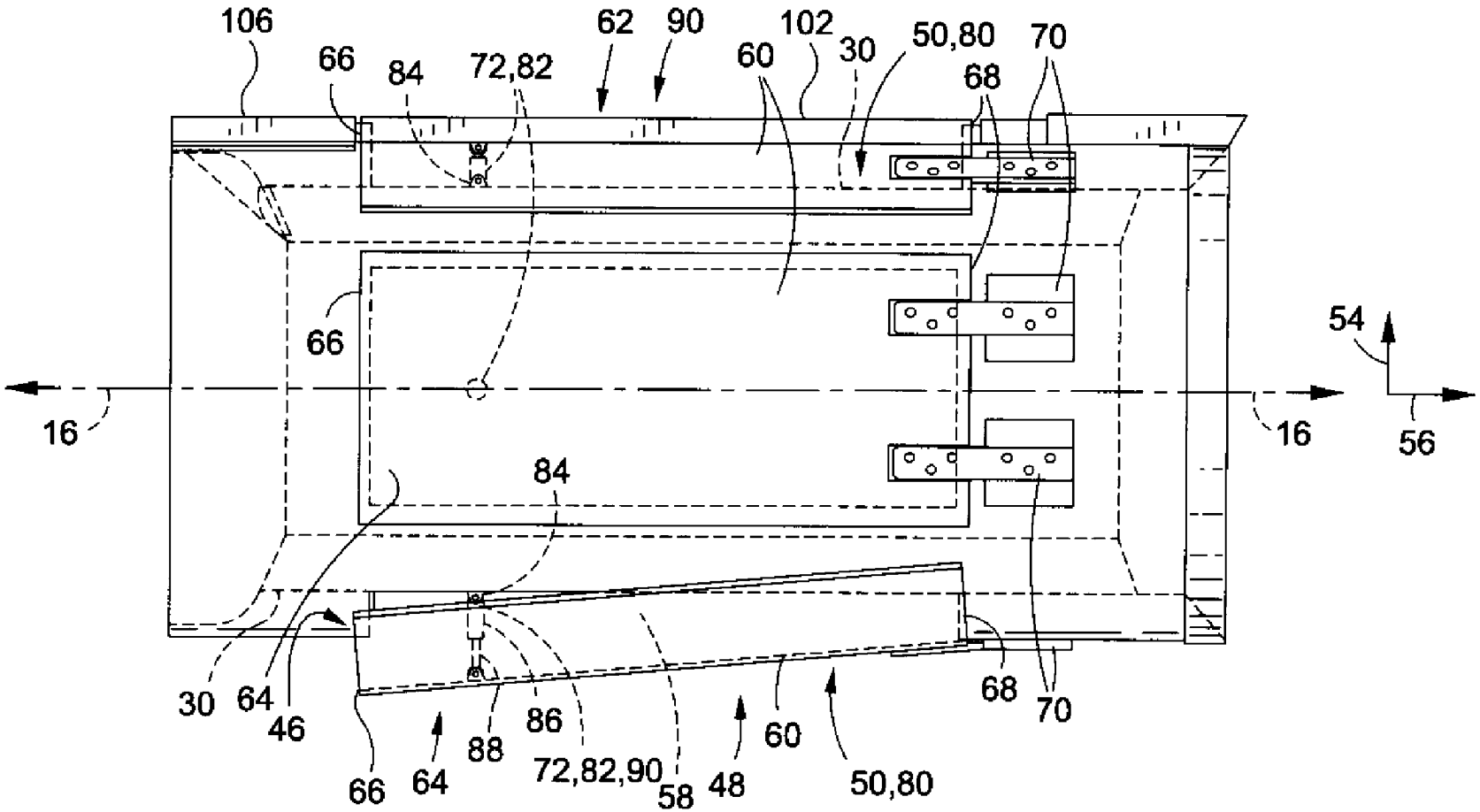
FIG. 5 is a top view of the steering head with a steering flap in the extended position with a powered actuator operative to extend the first flap face.

In FIG. 5, an embodiment of the steering head 10 is shown to have a plurality of steering flaps 50, 80, with one of the steering flaps 50, 80 having the first flap face 58 disposed radially away from the body surface 30 in an extended position 64.

Although the steering flaps 50, 80 depicted in FIGS. 1-2, 5-6 are generally rectangular, it is also contemplated within the scope of the present invention that the various aspects of the steering head 10 may be employed with a steering flap 50, 80 that has a polygonal, oval, square, or other configuration.

In one embodiment of the steering head 10, the hinge end 68 of the steering flaps 50, 80 may be positioned between approximately 8 to 18 inches from the lead edge 38, thereby enabling a quicker response time for the lead edge 38 to change direction. However, it is contemplated within the scope of the present invention that the hinge end 68 of the steering flaps 50 may be positioned less than 8 inches or more than 18 inches from the lead edge 38, depending on the requirements of the boring operation.

Referring now to FIGS. 1A, 2, and 5, an embodiment of the steering head 10 may further include a powered actuator 72, 82 mounted to the first flap face 58 of each steering flap 50, 80 and to the body surface 30 of the steering head 10. Each powered actuator 72, 82 when activated may be operative to extend the first flap face 58 into the extended position 64. Although the steering head 10 depicted in FIGS. 2 and 5 show a single powered actuator 72 mounted to each first flap face 58 on each steering flap 50, 80, and to the body surface 30, it is contemplated that the steering head 10 may include a plurality of powered actuators 72, 90 mounted to the first flap face 58 of each steering flap 50, and to the body surface 30. The powered actuator 72 may be a hydraulic electric or air actuator 82 having a motor 84 or a cylinder 86 mounted to the motor, and a shaft 88 disposable in the cylinder 86 mountable to each first flap face 58. As shown in FIGS. 5 and 6, the hydraulic actuator 82 may extend the first flap face 58 of one of the steering flaps 50, 80 into the extended position 64 by operation of the extension of the shaft 88 from the cylinder 86, thereby causing the hydraulic actuator 82 to open the steering flap 50, 80 radially away from the body surface 30.

Referring to FIGS. 1, 1A, 2 and 5, the steering head 10 is innovative in that the powered actuator 72 may be mounted to the first flap face 58 of the steering flap 50, 80 and the body surface 30 of the body 14. When operative, the powered actuator 72 may extend the first flap face 58 into the extended position 64, thereby enabling the steering head 10 to change the direction of its cutting path. In the extended position, the steering flap 50, 80 may encounter frictional resistance forces with the soil wall 11, thereby causing the lead edge 38 of the steering head 10 to move in a direction opposing the steering flap 50, 80 in the extended position 64. In one embodiment of the present invention, it is estimated that the amount of frictional resistance force applied by the soil wall 11 against the steering flap 50, 80 in the extended position 64 may be approximately 60 tons. However, it is contemplated within the scope of the present invention that the amount of force exerted by the soil wall 11 against the steering flap 50, 80 may be less than or exceed this amount.

For example, if a steering flap 50, 80 on the right side of the steering head 10 is in the extended position 64, the lead edge 38 will tend to move in a direction toward the left through the soil 11. These same frictional resistance forces will cause the lead edge 38 of the steering head 10 to tend toward an upward direction in the soil 11 with the steering flap 50, 80 in the extended position 64 on the bottom of the steering head 10, as depicted in FIGS. 5 and 6. Once the desired alignment has been achieved, the powered actuator 72 may then be deactivated. This configuration uniquely enables the biased hinge 70 at the hinge end 68 of the steering flap 50, 80 to automatically retract the steering flap 50, 80 into a completely closed position by operation of the spring action of the biased hinge 70 with the assistance of the frictional impact forces of the soil wall 11 pushing on the steering flap 50, 80. As discussed above, the biased hinge 70 may be spring-loaded or made of spring steel. The steering head 10 is thus more maneuverable through a desired cutting path in the soil 11, along both vertical and longitudinal axes in the soil. The steering head 10 is therefore able to operate more efficiently, thereby reducing the amount of time spent and power consumed in the boring operation on a project. The efficiency of the boring operation may also be improved because the steering flap 50, 80 is automatically rather than manually closed once the desired cutting path in the soil 11 has been determined. Furthermore, as the steering flap 50, 80 may be automatically closed by the biased hinge 70, the steering flap 50, 80 may be less likely to be deformed or allow soil to enter the steering head 10 underneath a steering flap 50, 80 in the extended position 64. Accordingly, the steering flap 50, 80 may not sustain damage as frequently during the boring operation and its longevity may therefore be increased.

Referring to FIG. 1B, another embodiment of the steering head 10 may also include one or more shields 118 laterally disposed on the first flap face 58 of the steering flap 50 adjacent to the outer tube 44 which may prevent soil 11 from entering beneath the steering flap 50 in the extended position 64. As a result, the shields 118 may protect the underlying body surface 30 and the powered actuator 72 mounted thereon. The shields 118 may also provide support to the steering flap 50 so as to reduce the occurrence of deformation of the steering flap 50 caused by frictional resistance and impact forces with the soil wall 11. A center rib 120 disposed between the shields 118 may provide further support to the steering flap 50.

A plurality of steering flaps 80 may enable an efficient change of direction of the steering head 10 toward the desired cutting path. For example, if a steering flap 50 on the right side of the steering head 10 is extended, a steering flap 50 on the left side of the steering head 10 may be retracted, thereby steering the lead edge 38 of the steering head 10 toward the left. Likewise, these same frictional resistance forces will cause the lead edge 38 of the steering head 10 to tend in an upward direction along a vertical soil axis 94 with the steering flap 50 on the bottom of the steering head 10 in the extended position 64 and with a steering flap 50 on the top of the steering head 10 in the retracted position 62, as shown in FIGS. 5 and 6. With the deactivation of the powered actuator 72 on a steering flap 50, 80, the configuration of the spring action on the biased hinge 70 of each deactivated steering flap 50 uniquely enables such steering flaps 50 to uniformly retract with the assistance of the frictional impact forces of the soil wall 11 on the steering flaps 50. As discussed above, this configuration may therefore improve the efficiency of the boring operation and the longevity of the steering head 10.

Although one of the steering flaps 50, 80 depicted in FIGS. 5-6 is shown to be slightly open in the extended position 64, as used herein, the term "extended position" 64 should not be construed narrowly but rather broadly to mean any opening of the steering flap 50, 80 intended to aid in changing the direction of the steering head 10. Furthermore, as used herein, the term "retracted position" 62 should not be construed narrowly, but rather broadly to mean the closure of the steering flap 50, 80.

Referring to FIGS. 1, 4 and 6, an embodiment of the steering head 10 may further include a rear hatch 106 on the outer tube 44 proximate to the second body end 20. The rear hatch 106 may be operative to cover at least one power and/or communication line 104 from an external control station 114 to the steering head 10. The power and/or communication line 104 between the external control station 114 and the steering head 10 may be operative to control the operation of the powered actuators 72 mounted to the first flap face 58 of the steering flaps 50, 80, as well as that of an altitude sensor 92, a first positional sensor 96, and/or a second positional sensor 100 on the steering head 10.

The altitude sensor 92 may be disposed on the outer tube 44 proximate to the second body end 20. The altitude sensor 92 may be operative to measure the position of the steering head 10 along a vertical soil axis 94 in the soil 11. With information obtained from the altitude sensor 92, the steering flaps 50, 80 may be adjusted such that the steering head 10 may be positioned to go higher and/or deeper into the soil 11, depending on the desired cutting path. In a further embodiment, the steering head 10 may also include a first positional sensor 96 on the rear lip 28 proximate to the second body end 20. The first positional sensor 96 may be operative to measure the position of the steering head 10 along a horizontal soil axis 98 in the soil 11. In yet a further embodiment, the steering head 10 may further include a second positional sensor 100 adjacent to the first positional sensor 98. The first positional sensor 96 and/or the second positional sensor 100 may for example be light fixtures operative to fix the position of the steering head 10 by illuminating the cutting path of the soil 11. With the information provided by the first positional sensor 96 and/or the second positional sensor 100, the steering flaps 50, 80 may be adjusted and the direction of the steering head 10 may accordingly be modified to the left or to the right in the soil 11, depending on the desired cutting path.

Referring to FIG. 1, another embodiment of the steering head 10 may also include a top box 102 on the outer tube 44 extending from the rear hatch 106 toward the first body end 18. The top box 102 may be operative to cover a multifunctional sensor 116 positioned underneath the top box 102. The multifunctional sensor 116, commonly referred to as SONE, may be operative to provide information about the depth, position, pitch, and roll of the steering head 10 in the soil 11, in addition to or in lieu of the information provided by the first positional sensor 96, the second positional sensor 100, and the altitude sensor 92. The power and/or communication line 104 between the external control station 114 and the steering head 100 may be operative to control the operation of the multifunctional sensor 116. With the multifunctional sensor 116 positioned closer to the lead edge 38 of the steering head 10, it is able to provide real time information about the location of the steering head 10 earlier than the first positional sensor 96, the second positional sensor 100, and the altitude sensor 92.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A steering head for use with an auger machine and a casing engageable to the auger machine for boring through soil, the steering head comprising:

a generally cylindrical body defining a longitudinal body axis, the body having a first body end and an opposing second body end, the second body end being mountable to the casing, the body further having a bore channel with a channel surface concentrically received in the body, a front lip radially extending from the bore channel proximate to the first body end, a rear lip radially extending from the bore channel proximate to the second body end, a body surface enveloping the body from the front lip to the rear lip, the body further having a lead edge radially extending from the front lip at the first body end, the lead edge having a first soil face and an opposing lead face;

an outer tube having an internal side and an opposing external side, the internal side generally facing and operative to cover the body surface and the lead face from the first body end to the second body end;

a steering flap disposed on the external side of the outer tube defining a longitudinal flap axis and a generally lateral flap axis disposed perpendicular to the longitudinal flap axis, the steering flap having a first flap face and an opposing second flap face, the first flap face disposable facing toward and generally parallel to the body surface in a retracted position, the first flap face disposable radially away from the body surface in an extended position, the steering flap further having a distal end and a hinge end, the hinge end generally disposed between the distal end and the lead edge, the hinge end being mountable to the outer tube by a biased hinge operative to retract the steering flap into the retracted position; and a powered actuator mountable to the first flap face and the body surface, the powered actuator when activated operative to extend the first flap face into the extended position.

2. The steering head as claimed in claim 1, wherein the body is made of metal.

3. The steering head as claimed in claim 1, wherein the lead edge is made of metal.

4. The steering head as claimed in claim 1 further includes a stiffening ring concentrically extending from the front lip proximate to the lead edge, the stiffening ring having a second soil face facing toward the longitudinal body axis and an opposing ring face covered by the outer tube facing away from the longitudinal body axis between the body surface and the lead face.

5. The steering head as claimed in claim 1 further includes a rear edge concentrically extending from the rear lip and mountable to the casing, the rear edge having a casing face facing toward the longitudinal body axis and an opposing rear face facing away from the longitudinal body axis, the rear face covered by the outer tube.

6. The steering head as claimed in claim 1 further includes a plurality of steering flaps disposed on the external side of the outer tube, each steering flap defining a longitudinal flap axis and a generally lateral flap axis disposed perpendicular to the longitudinal flap axis, each steering flap having a first flap face and an opposing second flap face, each first flap face disposable facing toward and generally parallel to the body surface in a retracted position, each first flap face disposable radially away from the body surface in an extended position, each steering flap further having a distal end and an opposing hinge end, each hinge end generally disposed between the distal end and the lead edge, each hinge end being mountable to the outer tube by a biased hinge operative to retract the steering flap into the retracted position.

7. The steering head as claimed in claim 1, wherein the biased hinge is spring-loaded.

8. The steering head as claimed in claim 1, wherein the biased hinge is made of a spring steel.

9. The steering head as claimed in claim 1 further includes a plurality of biased hinges on the hinge end of the steering flap.

10. The steering head as claimed in claim 1, wherein a plurality of powered actuators are mounted to the first flap face of the steering flap.

11. The steering head as claimed in claim 1, wherein the powered actuator is a hydraulic air actuator or hydraulic electric actuator mountable to the first flap face.

12. The steering head as claimed in claim 6 further includes a plurality of powered actuators, each steering flap having a powered actuator mountable to each first flap face.

13. The steering head as claimed in claim 1 further includes an altitude sensor disposed on the outer tube proximate to the second body end, the altitude sensor operative to measure the position of the steering head along a vertical soil axis in the soil.

14. The steering head as claimed in claim 1 further includes a first positional sensor on the rear lip proximate to the second body end, the first positional sensor operative to measure the position of the steering head along a horizontal soil axis in the soil.

15. The steering head as claimed in claim 14 further includes a second positional sensor adjacent to the first positional sensor.

16. The steering head as claimed in claim 1 further includes a rear hatch on the outer tube proximate to the second body end, the rear hatch operative to cover at least one power and/or communication line from an external control system to the steering head.

17. The steering head as claimed in claim 16 further includes a top box on the outer tube extending from the rear hatch toward the first body end.

18. The steering head as claimed in claim 17 further includes a multifunctional sensor covered by the top box operative to measure the depth, position, pitch, and roll of the steering head in the soil.

19. The steering head as claimed in claim 1 further includes one or more shields laterally positioned on the first flap face of the steering flap adjacent to the outer tube, the shields operative to prevent soil from entering beneath the steering flap in the extended position and to provide support to the steering flap.

20. The steering head as claimed in claim 19 further includes a center rib disposed proximate to the shields operative to provide additional support to the steering flap.

* * * * *

UNITED STATES PATENT AND TRADEMARK OFFICE

CERTIFICATE OF CORRECTION

PATENT NO. : 8,276,687 B2
APPLICATION NO. : 12/433587
DATED : October 2, 2012
INVENTOR(S) : Malcolm It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 348 days.

Signed and Sealed this
Nineteenth Day of August, 2014

Michelle K. Lee

Michelle K. Lee
*Deputy Director of the United States Patent and Trademark Office*